US005097990A

United States Patent [19]

Goncalves

[11] Patent Number: 5,097,990

[45] Date of Patent: Mar. 24, 1992

[54] DEVICE FOR AFFIXING A VALVE TO A PRESSURIZED CONTAINER, AND CONTAINER EQUIPPED WITH SUCH A DEVICE

[75] Inventor: Antonin Goncalves, Montmorency, France

[73] Assignee: L'Oreal, Paris, France

[21] Appl. No.: 404,492

[22] Filed: Sep. 8, 1989

[30] Foreign Application Priority Data

Sep. 12, 1988 [FR] France ..... 88 11860

[51] Int. Cl.[5] ..... B65D 83/00

[52] U.S. Cl. ..... 222/153; 222/402.1

[58] Field of Search ..... 222/402.13, 402.21, 222/402.22, 402.1, 532, 545, 562, 153; 220/319, 322

[56] References Cited

U.S. PATENT DOCUMENTS 3,933,283 1/1976 Hongland ..... 222/402.13
4,410,110 10/1983 Del Bon et al. ..... 222/402.1 X
4,529,105 7/1985 Lewins ..... 222/153
4,605,135 8/1986 Ryder ..... 222/153 X
4,735,346 5/1988 Stoody ..... 222/153
4,749,103 6/1988 Barriac ..... 222/153 X

FOREIGN PATENT DOCUMENTS 2013178 3/1969 Fed. Rep. of Germany .
2508136 6/1981 France .

*Primary Examiner*—Michael S. Huppert
*Assistant Examiner*—Anthoula Pomrening
*Attorney, Agent, or Firm*—Cushman, Darby & Cushman

[57] ABSTRACT

The invention relates to a device for fixation of valve (3) to a container (1); in this device, an annular collar (4) covers the flange (33) of the valve and assures the clamping of the valve gasket (7) by locking to the bead (23) of the container. A ring (5) surrounds the collar (4) and is screwed onto it, to prevent unlocking of the collar (4) under the influence of the internal pressure of the container.

10 Claims, 1 Drawing Sheet

DEVICE FOR AFFIXING A VALVE TO A PRESSURIZED CONTAINER, AND CONTAINER EQUIPPED WITH SUCH A DEVICE

BACKGROUND OF THE INVENTION

1. Field of the Invention

The present invention relates to a device for affixing a valve to a pressurized container and a container equipped with such a device.

2. Background Information

For dispensing liquids under pressure, a valve is affixed to the metal container intended to receive the fluid to be dispensed In a known manner, the valve comprises a valve body in which an ejection conduit is formed to assure the exit of the liquid Generally this valve is integrally joined to the upper portion of the container (when the container is placed on a base) with the aid of a metal collar, the fixation of which is done by crimping it either to the upper edge of the container or to the upper edge of a metal dome closing off the upper portion of the container However, a crimping collar cannot always be used; this is the case when the height required for the crimping would make the valve too high, as well as when the container has an oval form in horizontal section, because the diameter of the crimping collar is very close to the short axis of the oval section, if the container has relatively small dimensions. In that case it is necessary to use some other valve fixation system The problem is accordingly to discover a system that is sufficiently effective that there will be no risk that the valve will break off under the influence of the pressure inside the container.

SUMMARY OF THE INVENTION

The present invention relates to a device for fixation of a dispensing valve, the upper portion of the valve body of which includes a projecting flange, on a metal container intended to contain a pressurized fluid, the container having an upper edge for fixation of the valve comprising an annular bead of rolled sheet metal projecting to the outside of the container, characterized in that it includes:

a) an annular collar having a radial section in the form of a U, the crossbar or annular section of which is disposed toward the container and the arms of which have their median lines substantially parallel to the axis of the container, the inner arm of the U being longer than the outer arm, the inner arm of said radial section corresponding to an inner skirt, the outer arm corresponding to an outer skirt coaxial with the first and the crossbar of the U corresponding to an annular plate, said inner skirt being provided on the one hand, on its face toward the axis, in the vicinity of the annular plate, with locking means intended to be fitted under the fixation bead of the container and, on the other hand, on its opposite end, with nesting means of the flange of the valve body, at least the central zone of said flange not being covered by said nesting means, the outer skirt including a screw thread on its outer face;

b) a ring surrounding the collar and on its inside face including a screw thread corresponding to the screw thread of the outer skirt of the collar Preferably, the device includes a self-locking system one element of which is carried by the ring and the other by the plastic collar. This system may comprise rotation preventing teeth, some of them on the ring and the others on the outer face of the inner skirt of the plastic collar.

The nesting means of the collar of the valve body comprise an annular plate, perpendicular to the axis and resting on the upper face of the flange of the valve body, and a bead, preferably continuous, intended to be introduced under the flange of the valve body.

The fixation device according to the invention is not at risk of being broken off. In fact, the valve body is locked between the collar and the container, thanks to the nesting means of the upper portion of the valve body and the locking means under the annular bead of rolled sheet metal. Additionally, the plastic collar is reinforced by the ring, which when it is screwed on prevents any bellying of the portion of the inner skirt that carries the locking means, and hence assures that the valve body will be held on the container. Unscrewing of the ring is prevented by a self-locking system, for instance comprising radial fins carried by the ring on the one hand and by the flange on the other.

In the present invention, a sealing gasket is preferably disposed in a seat made on the upper face of the flange of the valve body and rests on the nesting means carried by the collar; this gasket enables a tight seal between the valve body and the collar. A gasket is also provided between the fixation bead of the container and nesting means of the collar, to assure tightness between the interior of the container and the collar. This assures perfect tightness of the closure about the valve body.

Preferably, at least part of the ring/collar threading is slightly conical, the angle at the apex of the cone being between 1° and 5° and the apex of the cone being located on the side of the ring away from the container. This improves the clamping of the collar to the valve body and container.

The ensuing detailed description is purely illustrative and non-limiting and will enable better comprehension of the invention, in conjunction with the drawings.

DESCRIPTION OF THE PREFERRED EMBODIMENT

Figure 1:
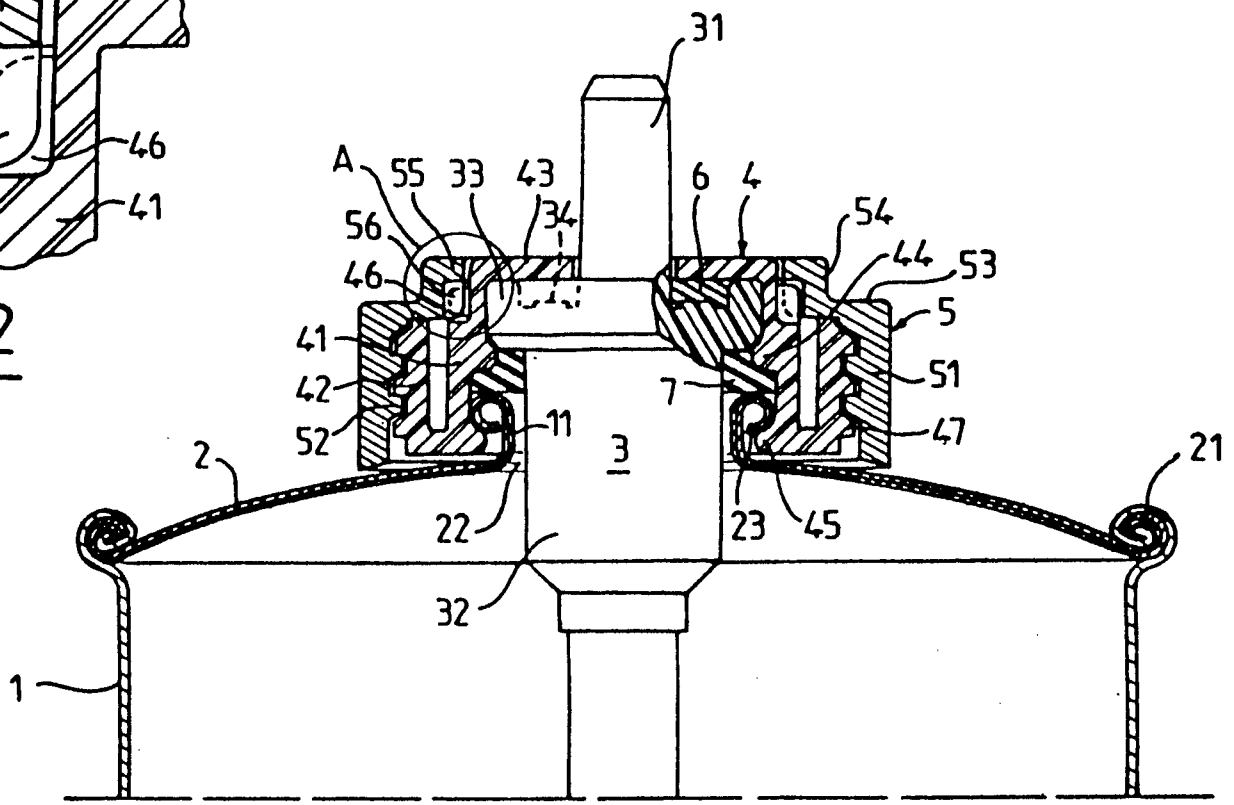
FIG. 1 is a diametrical sectional view of a valve fixation device according to the invention, put in place on a container, with the valve body shown only partly in section.
Figure 2:
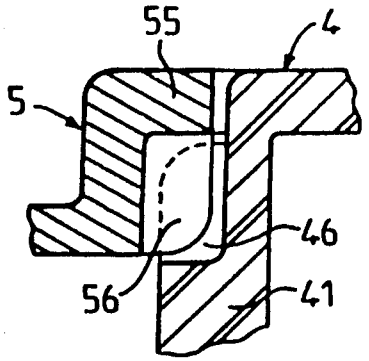
FIG. 2 is a view on a larger scale of the detail A of a FIG. 1.

The fixation device shown in the drawings is mounted on a pressurized container 1 closed in its upper portion with a metal dome 2 and provided with a valve 3. This fixation device includes a collar 4 surrounded by a ring 5 and provided with two gaskets 6 and 7.

The metal dome 2 is crimped with a crimping bead 21 on the upper edge of the container 1 intended to contain the fluid under pressure that is to be dispensed. It is provided with a circular opening 22 at its top, centered on the axis of the container 1. This opening 22 is defined by a cylindrical neck 11, the upper edge of which carries a fixation bead 23 projecting toward the outside of the container 1; this bead 23 is obtained by rolling the edge of the metal sheet forming the neck 11 toward the outside.

The valve 3 is disposed in the axis of the opening 22; it includes a valve body 32 in which an outlet tube 31 is mounted, in translation along the axis, for ejecting the fluid to be dispensed. In its upper portion, the valve body 32 is provided with a projecting flange 33, the upper face of which is located in a plane perpendicular to the axis of the valve.

The annular collar 4 has the shape of a U in radial section, including two arms, an inner and an outer arm, corresponding respectively to annular concentric skirts 41 and 42. The upper portion of the internal skirt 41, on its internal face turned toward the valve 3, includes nesting means for the flange 33 of the valve body 32. These means comprise an annular plate 43 perpendicular to the axis of the valve 3 that comes to rest on the upper flat face of the flange 33 of the valve body, and a bead 44 that comes to engage the underside of this flange 33. The plate 43 includes a central opening for the passage of the tube 31. In the lower portion of its inner face, the inner skirt 41 of the collar 4 includes a continuous annular retaining ring 45, which is engaged under the fixation bead 23 of the dome 2 and constitutes a means for locking the collar 4 on the dome 2. The upper portion of the inner skirt 41, on its outer face, is also provided with rotation preventing teeth 46. The outer skirt 42 of the collar 4, on its outer face, includes a slightly conical screw thread 47 (with a conicity of approximately 2°).

The annular ring 5 surrounds the collar 4. It includes a first, slightly conical portion 51, of which the angle at the apex of the cone is approximately 2°; this portion 51 has the same height as the outer skirt 42 of the collar 4 and on its inner face has a screw thread 52 cooperating with the screw thread 47 of the collar. Above the portion 51 is an annular flange 53 located in a plane perpendicular to the axis of the valve; this flange rests on the upper edge of the skirt 42 of the collar 4 when the ring 5 is screwed all the way onto the collar 4. The flange 53 has a cylindrical sleeve 54 terminating in a ring 55 perpendicular to the axis of the valve 3. Rotation preventing teeth 56 that cooperate with rotatior preventing teeth 46 of the collar 4 are affixed to the inner face of the cylindrical sleeve 54 and of the ring 55. The upper faces of the ring 55 of the fixation ring 5 and of the annular plate 43 of the collar 4 are disposed substantially in the same plane perpendicular to the axis of the valve when the ring 5 is screwed all the way onto the collar 4.

An annular gasket 6 is disposed in a seat 34 made on the upper face of the flange 33 of the valve body 32 and is compressed by the annular plate of the collar 4. A second annular gasket 7 is disposed between the valve body 32 and the inner face of the inner skirt of the collar 4; it is compressed between the fixation bead 23 of the dome 2 and the bead 44 of the nesting means for flange 33.

For mounting this fixation device, the gasket 6 is placed in the seat 34 made on the flange 33 of the valve body 32 and the gasket 7 is place about the valve body but below the flange 33. Next, the collar 4 is introduced around the valve 3 by nesting the flange 33 of the valve body 32 between the plate 43 and the upper bead 44 of the inner skirt 41 of the collar 4. The outlet tube passes through the plate 43 via the central opening thereof The component thus obtained is put in place on the container by introducing the valve body 32 into the container via the opening 22, until the gasket 7 rests on the fixation bead 23. By exerting force on the collar 4 along the axis of the container, the locking of the retaining ring 45 under the bead 23 is brought about. The ring 5 is then screwed on the outer skirt 42 of the collar 4; once the screwing is completed, the rotation preventing teeth 56 of the ring 5 and the rotation preventing teeth 46 of the collar 4 cooperate with one another and immobilize the ring in the screwed-on position. The valve 3 is then locked in a sealed fashion on the dome 2 of the container 1.

What is claimed is:

1. A device for fixation of a dispensing valve, the valve body of which includes a projecting flange at its upper portion, on a metal container intended for containing a pressurized fluid, the container including an axis and an annular bead of rolled sheet metal projecting toward the outside of the container, wherein the device includes:

a) an annular collar having an inner skirt portion and an outer skirt portion extending substantially parallel to said inner skirt portion, said skirt portions each having first ends and opposite second ends with said second ends being connected by an annular section located adjacent said annular bead of the container, said skirt portions extending substantially parallel to the axis of the container, the inner skirt portion being longer than the outer skirt portion, said inner skirt portion being provided on a side facing toward said axis, in the vicinity of the annular section, with locking means for fitting under the annular bead of the container and, adjacent said first end, with nesting means for the flange of the valve body, said flange having a central zone, at least the central zone of said flange being uncovered by said nesting means, the outer skirt portion including a screw thread on its outer face;

b) a ring surrounding the collar and having an inside face including a screw thread corresponding to the screw thread of the outer skirt portion of the collar.

2. A device as defined by claim 1, wherein said device includes a rotation preventing means having one element which is carried by the ring and another by the collar.

3. A device as defined by claim 2, wherein the rotation preventing means comprises a rotation preventing of which is carried by the ring and another by the collar.

4. The device as defined by one of claims 1, 2 or 3, wherein said inner skirt portion has an interior surface and said nesting means for the flange of the valve body are provided on said interior surface of said inner skirt portion and comprises an annular plate perpendicular to the axis of the container, said annular plate resting on said flange of the valve body, said nesting means including a bead inserted under the flange of said valve body.

5. A device as defined by claim 4, wherein the locking means intended for insertion under the annular bead of the container comprises a refraining ring.

6. A device as defined by claim 5, wherein the retaining ring is continuous.

7. A device as defined by one of claims 1-3, wherein a gasket is disposed in a seat provided on the upper portion of the flange of the valve body pot, said ring resting on the nesting means of the collar.

8. A device as defined by claim 7, wherein a gasket is disposed around the valve body, between the annular bead of the container and the nesting means for the flange of the valve body.

9. A device as defined by claim 5, wherein at least part of the threading of the ring and collar is slightly conical.

10. A pressurized container equipped with a valve fixation device as defined by one of claims 1-3.

* * * * *